US007424754B2

(12) United States Patent
Ingram et al.

(10) Patent No.: US 7,424,754 B2
(45) Date of Patent: Sep. 16, 2008

(54) WATER-PROOF JOINT FOR TUB AND SHOWER SURROUNDS

(75) Inventors: Scott Ingram, Lasalle (CA); Brent Thomas, Enville, TN (US)

(73) Assignee: Aqua Glass Corporation, Adamsville, TN (US)

( * ) Notice: Subject to any disclaimer, the term of this patent is extended or adjusted under 35 U.S.C. 154(b) by 368 days.

(21) Appl. No.: 10/325,540

(22) Filed: Dec. 19, 2002

(65) Prior Publication Data

US 2004/0117908 A1 Jun. 24, 2004

(51) Int. Cl.
*A47K 3/02* (2006.01)

(52) U.S. Cl. ..... 4/584

(58) Field of Classification Search ..... 4/584, 4/613; 52/35

See application file for complete search history.

(56) References Cited

U.S. PATENT DOCUMENTS 3,605,352 A * 9/1971 Ruggles et al. ..... 52/35
3,800,335 A * 4/1974 Buonaura ..... 4/613
3,827,086 A * 8/1974 Seymour et al. ..... 52/35
4,671,026 A 6/1987 Wissinger
4,893,450 A 1/1990 Donaldson et al.
5,159,723 A 11/1992 Benedict
5,311,707 A 5/1994 LaRoche et al.
5,671,489 A * 9/1997 Salach ..... 4/614
5,870,878 A 2/1999 Swingle
5,950,370 A 9/1999 Peck
5,983,583 A 11/1999 Mattix et al.

FOREIGN PATENT DOCUMENTS

EP 0532827 * 3/1992 ..... 4/613

* cited by examiner

*Primary Examiner*—Charles E. Phillips
(74) *Attorney, Agent, or Firm*—Carlson, Gaskey & Olds

(57) ABSTRACT

A molded tub and surround which is formed of a multiple of portions. Wall portions meet a tub portion at a joint with a retaining ledge which extends inward toward a tub bowl from a flange. A ledge interface within the bottom of the wall portions engages the ledge. An angled interface surface is located directly in front of the ledge and slopes downward toward the bowl. A shallow interface within the bottom of the wall portions engages the angled interface surface.

1 Claim, 2 Drawing Sheets

WATER-PROOF JOINT FOR TUB AND SHOWER SURROUNDS

BACKGROUND OF THE INVENTION

The present invention relates to a waterproof joint between two portions of a molded plastic tub surround.

Tub and shower surrounds are positioned within a recess built around a bathtub or shower. Conventional modular tub/shower units often include a tub portion at the bottom and two or more wall portions. The whole structure is inserted into the wall recess to form a waterproof surround. The fully enclosed waterproof structure is highly advantageous in that it prevents the escape of water into the wall cavity despite the shower spraying water onto the surrounding walls.

One problem which has always arisen with products of this type is that of forming a suitable joint between the tub surround portions. Various styles of joint have been used, each of which providing particular tradeoffs in complexity, aesthetics, and sealing ability.

Accordingly, it is desirable to provide a waterproof joint between a wall portion for a molded plastic tub surround which is uncomplicated and aesthetically pleasing while assuring an effective watertight seal.

SUMMARY OF THE INVENTION

The present invention provides a joint for a molded tub and surround which is formed of a multiple of portions. A tub portion receives wall portions to form the combined tub and surround. The tub portion defines a horizontal deck area with a retaining ledge which extends inward toward the tub bowl from a flange.

A ledge interface within the bottom of the wall portions engages the retaining ledge. The weight of the wall portions compress a caulking compound to fill any potential voids therebetween. The height of the ledge further provides a barrier to prevent water from pooling behind the wall portions during and after usage. The retaining ledge operates to resist pressure exerted upon the lower portion of the wall portions such as, for example only, should a person push upon the wall portions.

An angled interface surface is located directly in front of the ledge and slopes downward toward the bowl. A shallow interface within the bottom of the wall portions engages the angled interface surface.

The retaining ledge and the angled interface surface assures an effective watertight molded tub and surround which is effectively invisible when installed.

The present invention therefore provides a waterproof joint between a wall portion and tub portion of a molded plastic tub surround which is uncomplicated and aesthetically pleasing.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
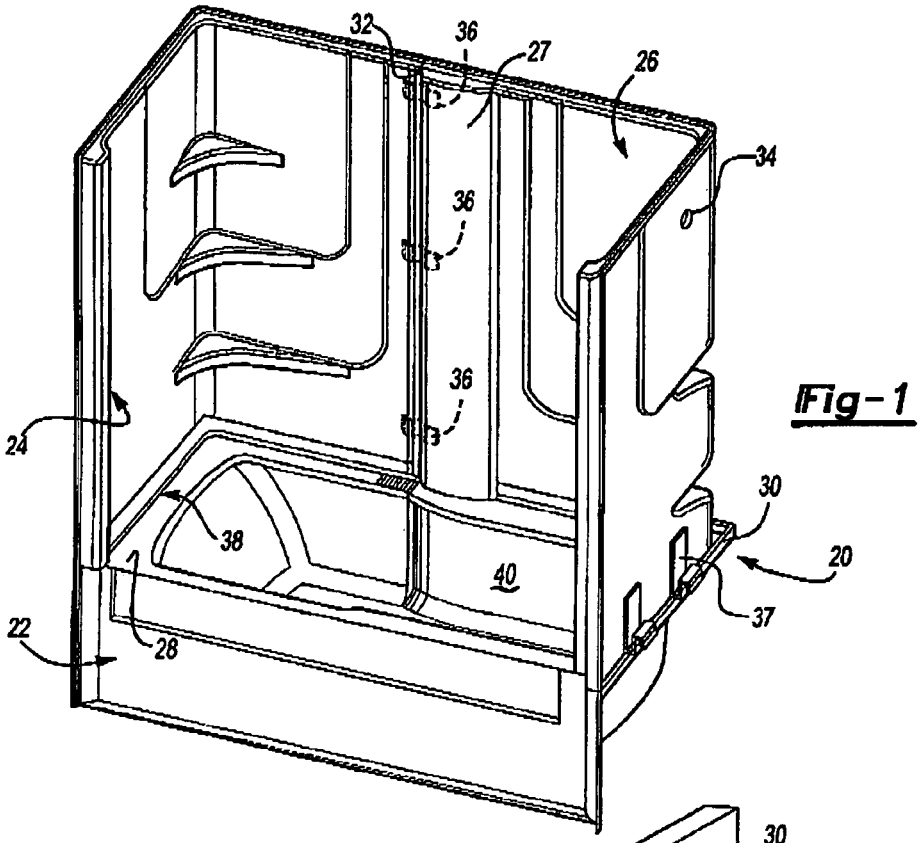
FIG. 1 is a general perspective view a molded tub and surround according to the present invention.

FIG. 1 illustrates a general perspective view of a molded tub and surround 20 which is formed of three pieces of molded plastic. A tub portion 22 receives wall portions 24 and 26 to form the combined tub and surround 20. It should be understood that any number of wall portions will benefit from the present invention. The tub portion 22 defines a horizontal deck area 28 and a substantially vertical flange 30 extending therefore. The flange may also be known as a nailing flange. The flange 30 preferably extends along three sides of the tub portion 22 behind the wall portions 24, 26 when in an assembled condition. It should be understood that the term "tub" is not limited to bath tubs only and that relatively shallow shower bases and the like will also benefit from the present invention.

A joint 32 is defined between the wall portions 24 and 26. A showerhead opening 34 is located within the wall 26 such that water will move in the direction of right to left in FIG. 1. That is, wall portion 26 is considered the "wet" wall as it is closer to showerhead opening 34. The wall portion 26 includes a partially arcuate portion 27 which engages wall portion 24 to define joint 32. A plurality of wall clamps 36 are spaced vertically along wall portion 26 to span the joint 28. Preferably, the wall clamps 36 are affixed to wall portion 26 through an adhesive or the like. It should be understood that various attachment devices such as clamps and fasteners will benefit from the present invention.

A joint 38 is also defined between the wall portions 24 and 26 and the deck 28 of the tub portion 22. The joint 38 is defined where the wall portions 24 and 26 meet the deck 28 between the flange 30 and the tub bowl 40. A plurality of tub clamps 37 are spaced along the flange 30 to maintain a predefined distance between the wall portions 24 and 26 and the flange 30. It should be understood that various attachment devices such as clamps and fasteners will benefit from the present invention.

Figure 3:
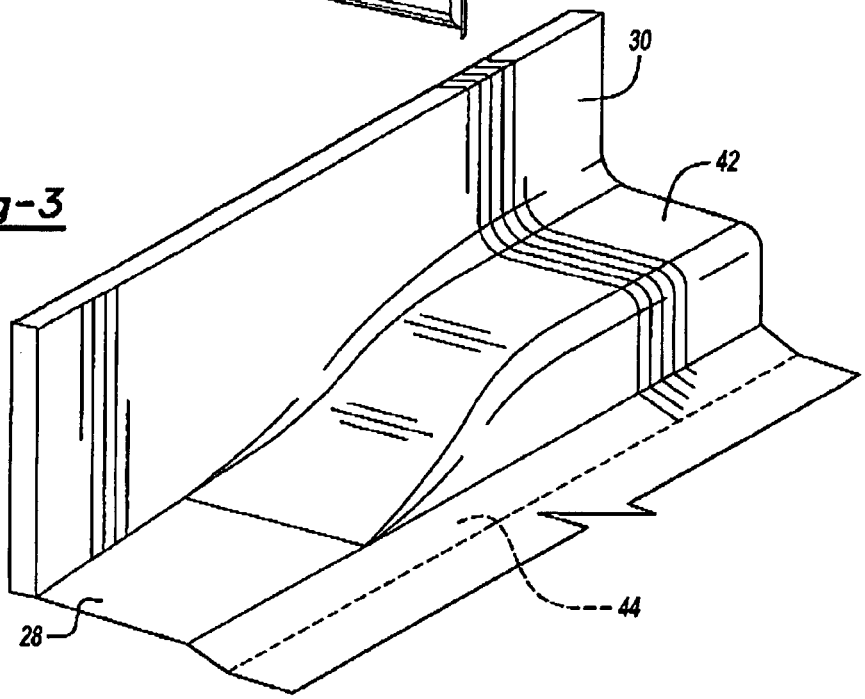
FIG. 3 is a further expanded view of the joint of FIG. 2.
Figure 2:
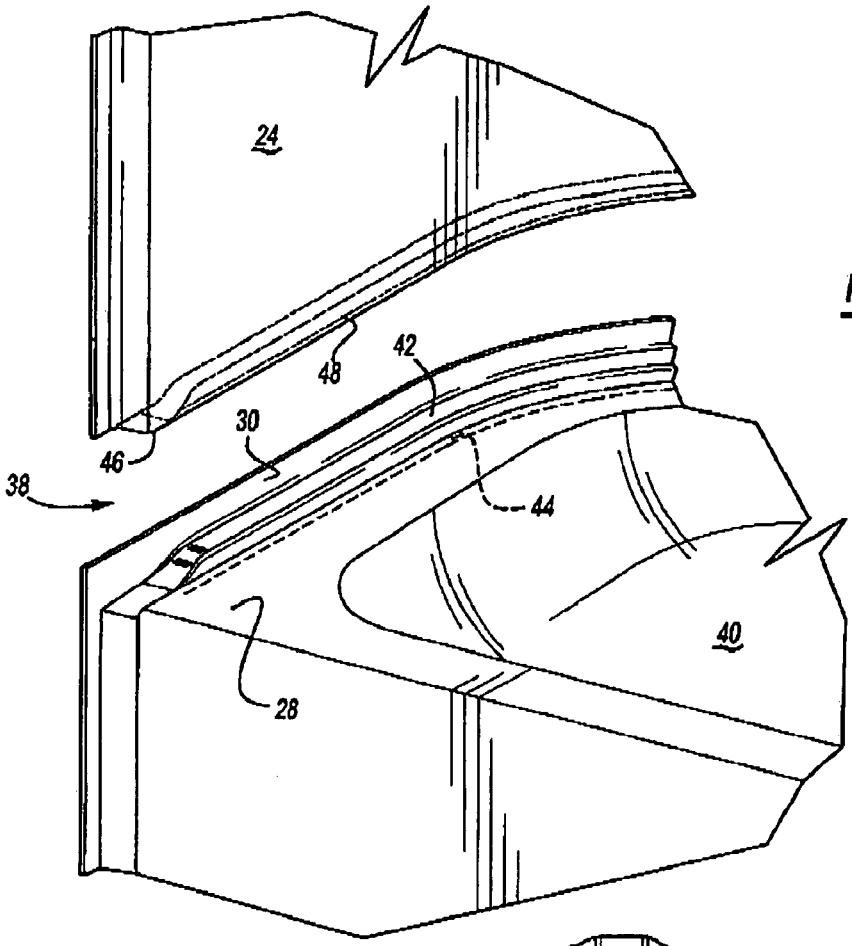
FIG. 2 is an expanded view of a joint.
Figure 4:
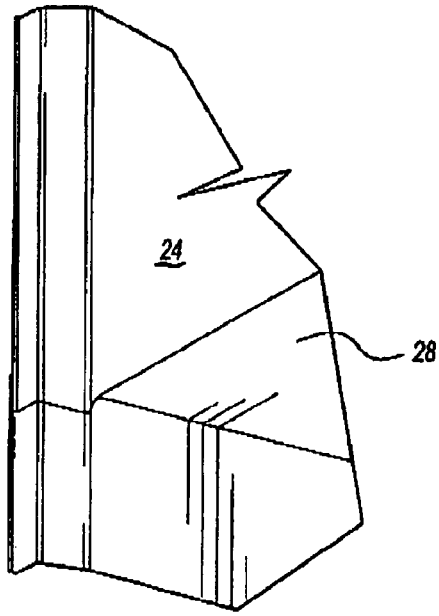
FIG. 4 is a perspective view of the joint in an assembled condition.

Referring to FIG. 2, the joint 38 is illustrated prior to assembly. The joint 38 includes a retaining ledge 42 and an angled interface surface 44 (also illustrated in FIG. 3). The retaining ledge 42 is a step extending inward toward the bowl 40 from the flange 30. That is, the retaining ledge 42 extends horizontally from the flange 30 then turns approximately 90 degrees downward to meet the deck 28. Preferably, the ledge 42 extends less than an inch above the deck 28.

A ledge interface 46 within the bottom of the wall portions 24 and 26 preferably engages the ledge 42. Ledge interface 46 is effective the opposite of the ledge 42 to receive ledge 42 therein. A sealing compound such as caulking is applied to the ledge 42 prior to installation of the wall portions 24 and 26. The weight of the wall portions 24 and 26 compress the caulking to fill any potential voids therebetween. The height of the ledge 42 further provides a barrier to prevent water from pooling behind the wall portions 24 and 26 during and after usage. The potential for mold and mildew is thereby reduced.

The retaining ledge 42 further operates to resist pressure exerted upon the lower portion of the wall portions 24 and 26 such as, for example only, should a person push upon the wall portions 24 and 26.

The angled interface surface 44 is located directly in front of the ledge 42 and slopes downward toward the bowl 40. Preferably, the angled interface surface 44 slopes downward at an approximately 7 degree angle. It should be understood that any somewhat shallow angle will also benefit from the present invention. A shallow interface 48 within the bottom of the wall portions 24 and 26 engages the angled interface surface 44. As the shallow interface 48 engages the angled interface surface 44 an exceeding tight joint is formed which prevents water infiltration. Moreover, as the angled interface surface 44 slopes downward toward the bowl 40, gravity assists in preventing water from leaching back behind the wall portions 24 and 26.

The retaining ledge 42 and an angled interface surface 44 assure an effective watertight molded tub and surround 20 which is effectively invisible when installed. It should be understood that a sealing compound may additionally be located on both sides of joints 32, 38 to further assure watertight integrity.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A tub surround comprising:

a first wall portion; and a tub portion comprising a flange, a deck, and a retaining ledge therebetween, said first wall portion engageable with said retaining ledge and an angled interface surface adjacent said retaining ledge, said angled interface surface angled away from said retaining ledge at approximately 7 degrees.

* * * * *